US006319072B1

(12) United States Patent
Takahashi

(10) Patent No.: US 6,319,072 B1
(45) Date of Patent: Nov. 20, 2001

(54) INSERT-MOLDED BODY FOR AN ELECTRICAL CONNECTOR AND METHOD OF MOLDING THE SAME

(75) Inventor: Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/592,271

(22) Filed: Jun. 12, 2000

(30) Foreign Application Priority Data

Jun. 11, 1999 (JP) ..... 11-165329

(51) Int. Cl.[7] ..... H01R 13/405
(52) U.S. Cl. ..... 439/736; 361/813
(58) Field of Search ..... 439/885, 736; 361/813

(56) References Cited

U.S. PATENT DOCUMENTS 3,173,732 * 3/1965 James ..... 439/74
3,960,424 * 6/1976 Weisenburger ..... 439/66
6,068,523 * 5/2000 Takahashi ..... 439/736

* cited by examiner

*Primary Examiner*—Tulsidas Patel
*Assistant Examiner*—Hae Moon Hyeon
(74) *Attorney, Agent, or Firm*—Armstrong, Westerman, Hattori, McLeland & Naughton, LLP

(57) ABSTRACT

An insert-molded body and a molding method thereof are provided, which insert-molded body includes: a primary molded body having a first resin portion and a second resin portion; a terminal assembly consisting of one or a plurality of strip terminals; a bent portion formed on the terminal assembly and bent in a suitable angle; a first engaging portion and a second engaging portion protrusively provided on respective sides of the bent portion in a same direction; a first abutting face and a second abutting face provided on the first engaging portion and the second engaging portion, respectively; and a first end face and a second end face provided on the first resin portion and the second resin portion, respectively, wherein the first abutting face and the second abutting face abut against the first end face and the second end face, respectively, due to elastic restoring force arising on the terminal assembly by changing a bending angle of the bent portion. Thus, the structure of a metal mold to mold the primary molded body can be simplified, and trouble to assemble the terminal assembly to the primary molded body can be reduced.

3 Claims, 10 Drawing Sheets

INSERT-MOLDED BODY FOR AN ELECTRICAL CONNECTOR AND METHOD OF MOLDING THE SAME

BACKGROUND OF THE INVENTION

1. Field of the Invention

The present invention generally relates to an insert-molded body and a molding method thereof and more particularly to an insert-molded body used, for example, in the antilock braking system applied to a motor vehicle.

2. Description of the Related Art

Conventionally, an insert-molded body as shown in FIG. 16 is suggested.

As is shown in FIG. 16, an insert-molded body 80 has a primary molded body 81 to be formed by the first molding, which primary molded body 81 is provided with a locking group 83 in a resin portion 82. And, a terminal assembly 84 consisting of a plurality of strip terminals 85 is assembled to the locking group 83 (cf. FIG. 18). The primary molded body 81 and the terminal assembly 84 are formed in a L-shape. As shown in FIG. 17, the locking group 83 is molded in both of an upper end surface 82*a* and a back 82*b* of the resin portion 2.

With respect to the above insert-molded body 80, however, a pair of metal molds (not illustrated) and another metal mold (not illustrated) to slid in a direction crossing at a right angle to an opening-and-closing direction of the pair of metal molds are required in order to form the above locking groups 83. Therefore, the structure of metal molds are complicated. And, the strip terminal 85 of the terminal assembly 84 is to be assembled to the locking group 83 one by one, which takes a lot of time or trouble to assemble the terminal assembly 84 to the primary molded body 81.

SUMMARY OF THE INVENTION

In view of the foregoing, an object of the present invention is to provide an insert-molded body and a molding method thereof wherein the structure of a metal mold for forming a primary molded body is simplified and trouble to assemble a terminal assembly to the primary molded body is reduced.

In order to achieve the above-described object, as a first aspect of the present invention, a insert-molded body comprises: a primary molded body having a first resin portion and a second resin portion; a terminal assembly consisting of one or a plurality of strip terminals; a bent portion formed on the terminal assembly and bent in a suitable angle; a first engaging portion and a second engaging portion protrusively provided on respective sides of the bent portion in a same direction; a first abutting face and a second abutting face provided on the first engaging portion and the second engaging portion, respectively; and a first end face and a second end face provided on the first resin portion and the second resin portion, respectively, wherein the first abutting face and the second abutting face abut against the first end face and the second end face, respectively, due to elastic restoring force arising on the terminal assembly by changing a bending angle of the bent portion.

As a second aspect of the present invention, in the structure with the above first aspect, the first and second engaging portions of the terminal assembly are provided with respective inclined planes to facilitate abutment against the respective first and second end faces.

As a third aspect of the present invention, in the structure with the above first aspect, the terminal assembly is tabular.

As a fourth aspect of the present invention, in the structure with the above second aspect, the terminal assembly is tabular.

As a fifth aspect of the present invention, a molding method of an insert-molded body comprises the steps of: molding a primary molded body having a first resin portion and a second resin portion having a first end face and a second end face, respectively; forming a terminal assembly consisting of one or a plurality of strip terminals; forming a bent portion by bending the terminal assembly in a suitable angle; protrusively providing a second engaging portion and a first engaging portion on the terminal assembly at respective sides of the bent portion in a same direction; forming a first abutting face and a second abutting face on the first engaging portion and the second engaging portion, respectively; hanging the first abutting face on the first end face of the first resin portion; hanging the second abutting face on the second end face of the second resin portion, while elastically deforming the terminal assembly; and holding the terminal assembly on the primary molded body by means of elastic restoring force arising on the terminal assembly.

According to the above-described structure of the present invention, the following advantages are provided.

(1) The bent portion is provided on the terminal assembly, the terminal assembly is elastically deformed about the bent portion, and the first and second abutting faces of the terminal assembly are engaged with the end planes of the first and second resin portions. Therefore, the assembled state between the primary molded body and the terminal assembly can be securely held due to the elastic restoring force arising on the terminal assembly, thereby eliminating to form a means for assembling the terminal assembly to the primary molded body at the stage of the primary molding. That is, the structure of the metal mold used to mold the primary molded body can be simplified, and manufacturing cost of the primary molded body can be reduced.

(2) Because the terminal assembly consisting of one or a plurality of strip terminals is capable of bending in a suitable angle, the terminal assembly can be elastically deformed about the bent portion. The first engaging portion and the second engaging portion are protrusively-provided on the respective sides of the bent portion, which first and second engaging portions are provided with the respective first and second abutting faces. Accordingly, the first abutting face can be hung on the end plane of the first resin portion, and the second abutting face can be hung on the end plane of the second resin portion after the terminal assembly is elastically deformed. That is, the terminal assembly can be easily assembled to the primary molded body by means of elastically deforming the terminal assembly. And, the assembled state between the primary molded body and the terminal assembly can be securely held due to the elastic restoring force arisen on the terminal assembly. Therefore, because the strip terminals constituting the terminal assembly need not to be assembled to the primary molded body one by one, trouble or time necessary for forming the insert-molded body can be reduced.

The above and other objects and features of the present invention will become more apparent from the following description taken in conjunction with the accompanying drawings.

DESCRIPTION OF THE PREFERRED EMBODIMENT

An embodiment of the present invention will now be described in further detail with reference to the accompanying drawings.

FIGS. 1–15 show an embodiment of the insert-molded body in accordance with the present invention.

Figure 1:
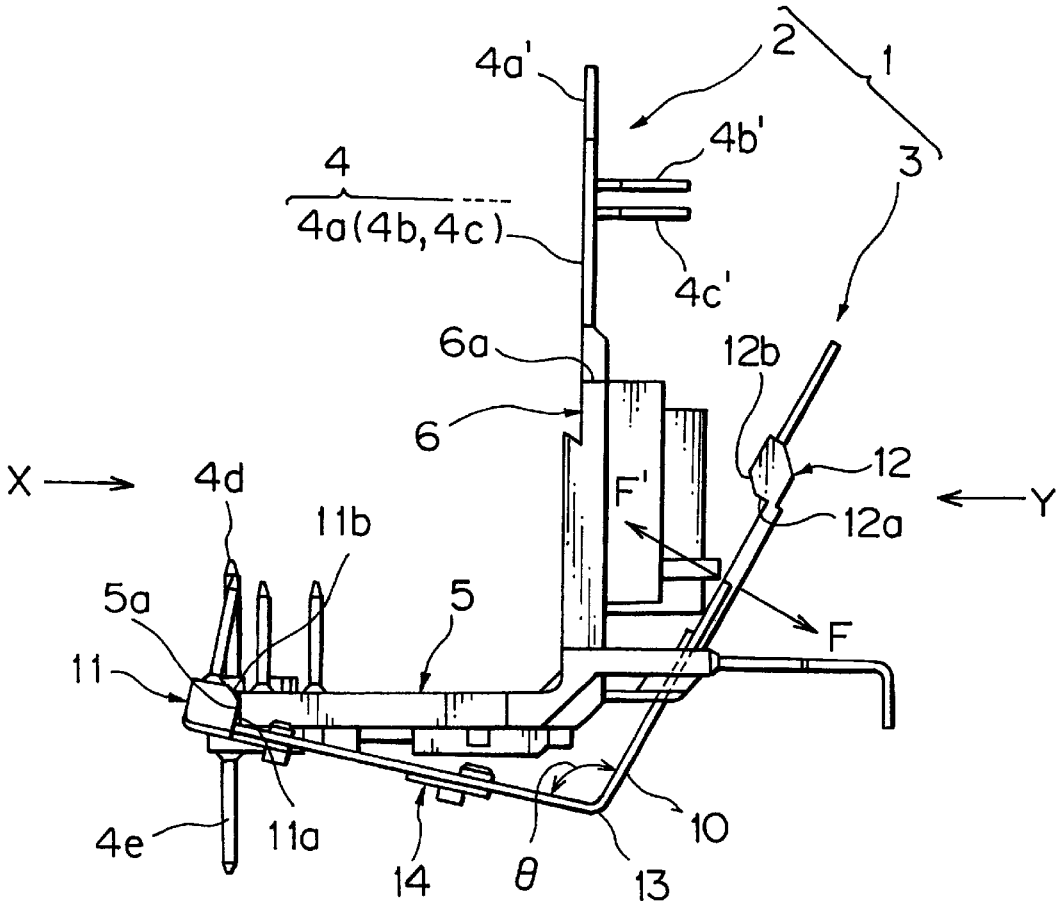
FIG. 1 is a side view showing an embodiment of the insert-molded body in accordance with the present invention.

As is shown in FIG. 1, a insert-molded body consists of a primary molded body 2 and a terminal assembly 3 to be assembled to the primary molded body 2, which terminal assembly 3 is held by means of its own elastic restoring force.

As shown in FIGS. 2–5, the primary molded body 2 has a plurality of arranged strip terminals 4*a*,4*b*,4*c*, and 4*e* (generalized with reference character 4), a first resin portion 5 to bundle up and support the strip terminals 4, and a second resin portion 6. The strip terminals 4*a* to 4*e* are arranged by every same kind. And, one end portions or/and the other end portions of the strip terminals 4 are formed in tab-like. Reference characters 4*a*′, 4*b*′, and 4*c*′ are connecting bands of the respective strip terminals 4*a*,4*b*, and 4*c* provided for facilitating the primary-molding. The strip terminals 4 are bent in a L-shape. In the present embodiment, the strip terminals 4 are in a L-shape, but other shapes may be applied.

Figure 2:
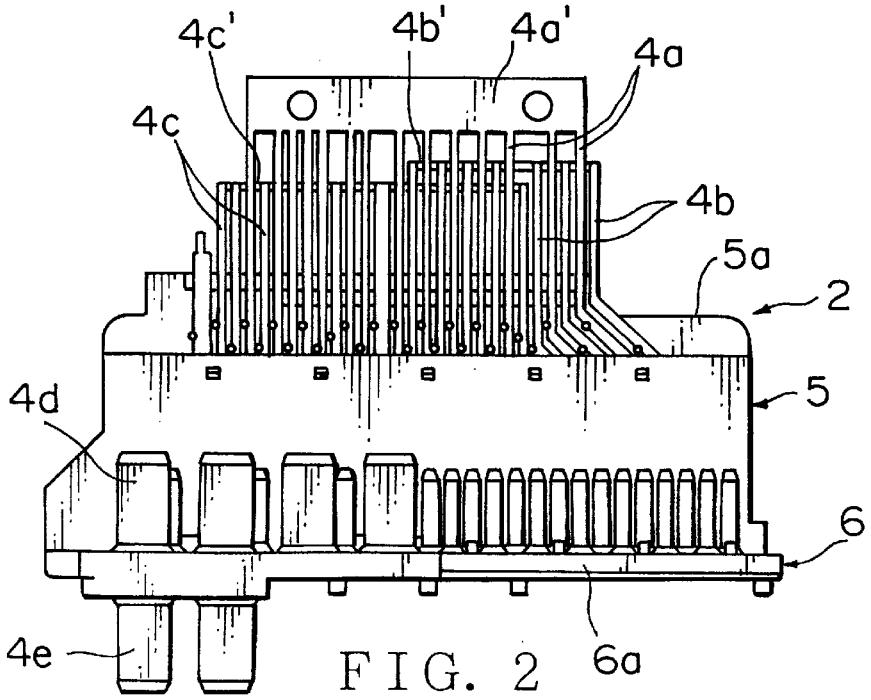
FIG. 2 is a plan view, taken along arrow X, of the primary molded body of FIG. 1.
Figure 3:
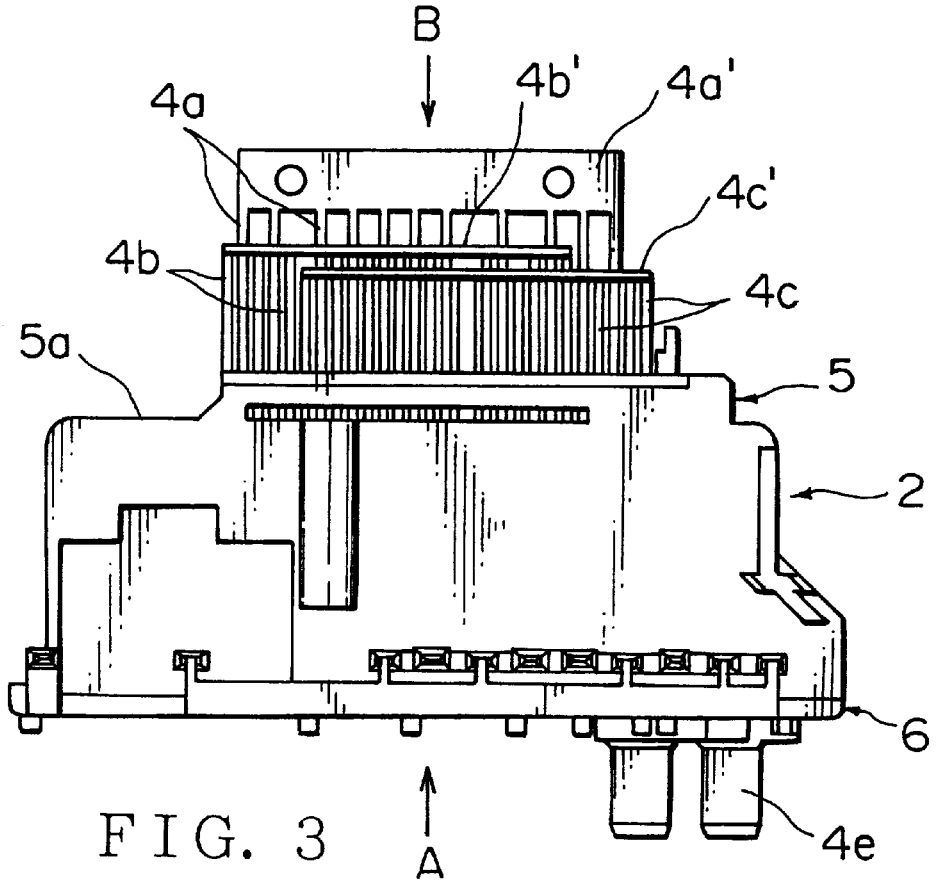
FIG. 3 is rear view, taken along allow Y in FIG. 1, of the primary molded body of FIG. 2.
Figure 4:
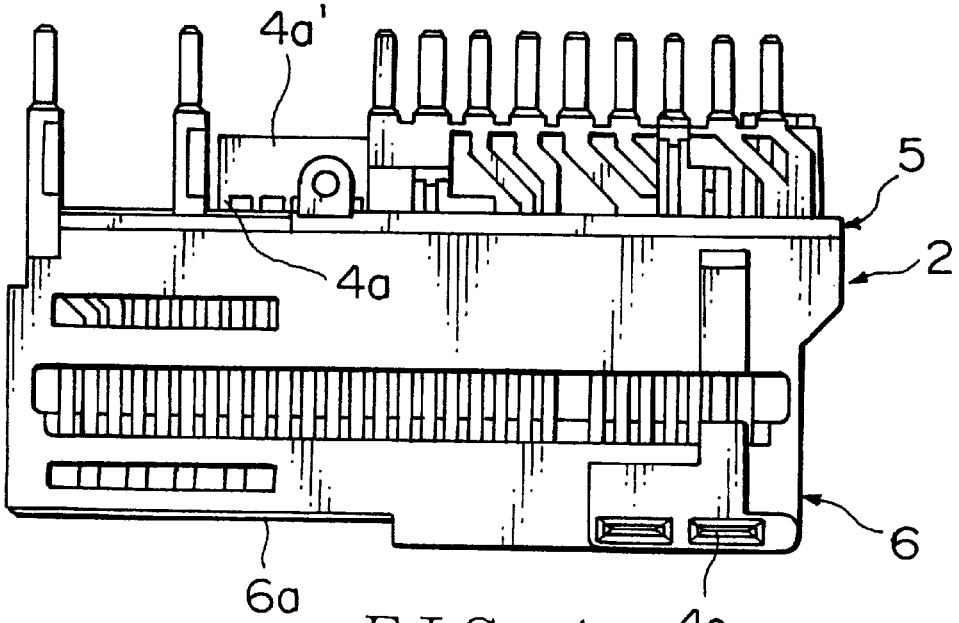
FIG. 4 is a side view, taken along arrow A, of the primary molded body of FIG. 3.
Figure 5:
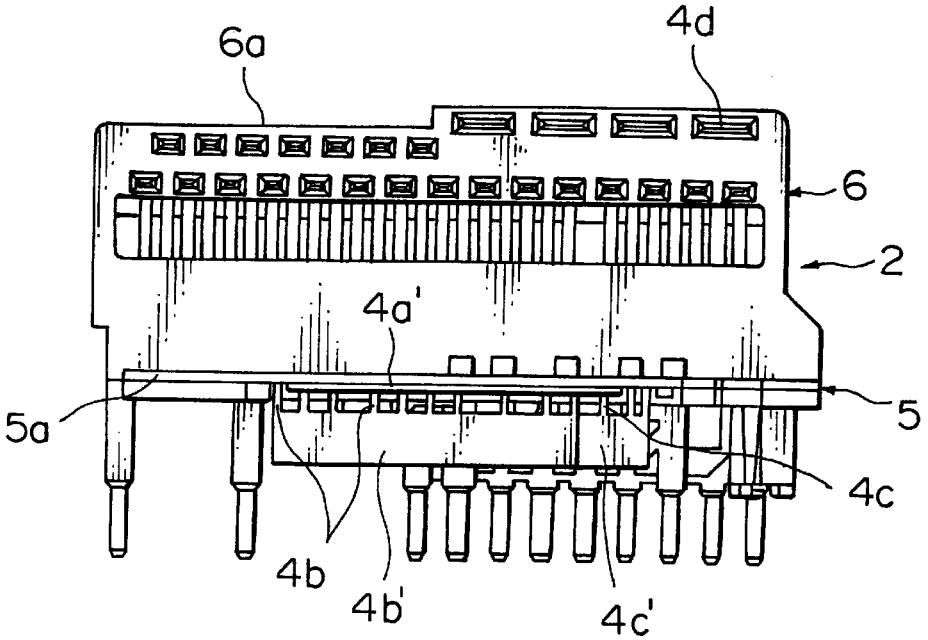
FIG. 5 is also another side view, taken along arrow B, of the primary molded body of FIG. 3.

As shown in FIGS. 1,2, and 5, a first end face 5*a* and a second end face 6*a* to hang the terminal assembly 3 are formed at the first resin portion 5 and the second resin portion 6, respectively. The first end face 5*a* and the second end face 6*a* face outward each other. However, the first end face 5*a* and the second end face 6*a* may be formed to face inward each other. Before the primary molding with insulative resin, the strip terminals 4 are flat. A plurality of strip terminals 4 are primary-molded in a state of being arranged in parallel. After the primary molding, the primary molded body 2 is formed by bending the strip terminal 4 at a suitable position.

Figure 6:
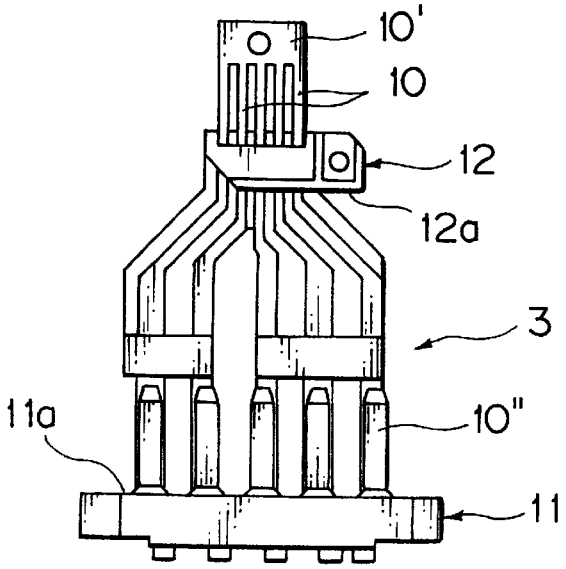
FIG. 6 is a plan view of the terminal assembly of FIG. 1.
Figure 7:
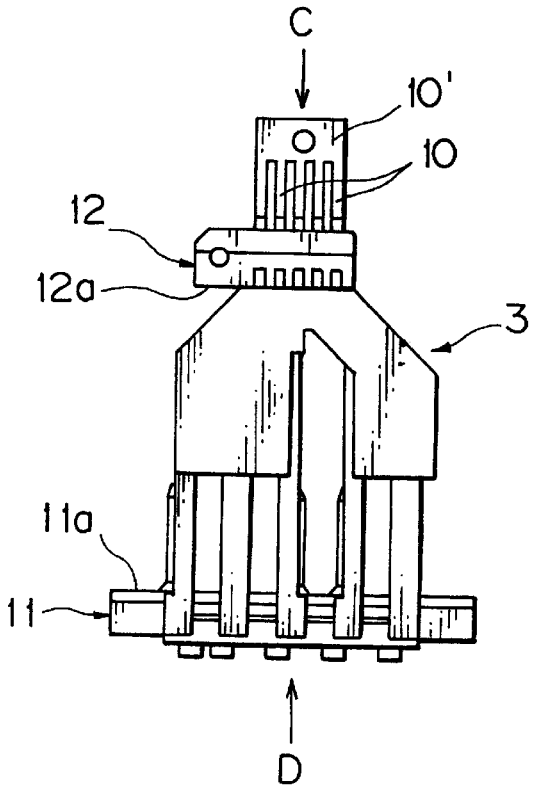
FIG. 7 is a rear view of the terminal assembly of FIG. 6.
Figure 8:
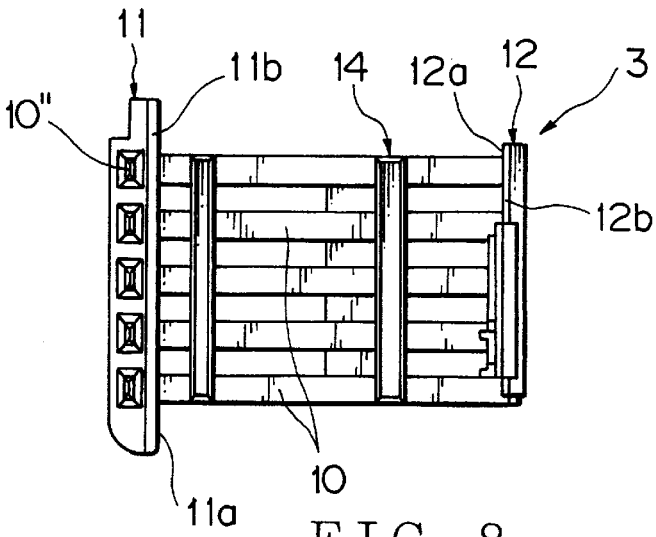
FIG. 8 is a side view, taken along arrow C, of the terminal assembly of FIG. 7.

As shown in FIGS. 6–9, the terminal assembly 3 consists of a first engaging portion 11 and a second engaging portion 12 wherein a plurality of strip terminals are arranged and pre-molded, which first and second engaging portions 11,12 are provided with a first abutting face 11*a* and a second abutting face 12*a*, respectively. The plurality of strip terminals 10 constituting the terminal assembly 3 is tabular and flat before they are pre-molded, and a bent portion 13, which is bent in a suitable angle, is formed after the pre-molding. As shown in FIG. 1 and FIG. 8, inclined planes 11*b*, 12*b* to facilitate engagement or fitting of the first engaging portion 11 and the second engaging portion 12 to the first end face 5*a* and the second end face 6*a*, respectively, are formed on the first engaging portion 11 and the second engaging portion 12, respectively. As shown in FIG. 6, a connecting band 10' to connect the strip terminals 10 is formed at one end portion of the strip terminals 10 for facilitating the pre-molding. And, tab-like connecting pieces 10" are formed at the other end of the strip terminals 10.

Figure 9:
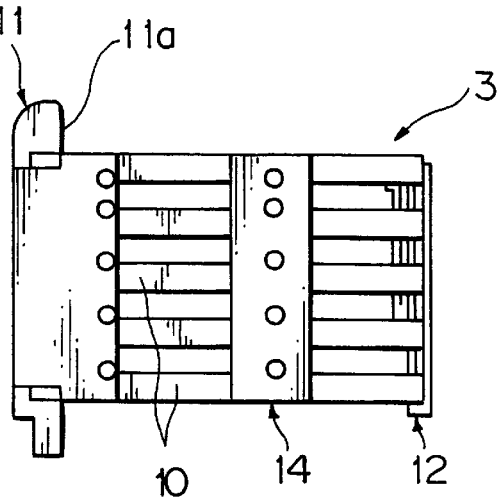
FIG. 9 is a side view, taken along arrow D, of the terminal assembly of FIG. 7.

The terminal assembly 3 may be formed with a single strip terminal 10. In the present embodiment, the terminal assembly 3 is in almost the same form as the primary molded body 2. As shown in FIGS. 1,8, and 9, reference character 14 is a resin band to bundle up and support a plurality of strip terminals 10. The strip terminal 10 is held a pin (not illustrated) provided on a metal mold (not illustrated) at the insert-molding.

As shown in FIG. 1, the first engaging portion 11 and the second engaging portion 12 are arranged at the respective ends of the terminal assembly 3 and protruding in the same direction. That is, the bent portion 13 is arranged between the first engaging portion 11 and the second engaging portion 12. The first abutting face 11*a* and the second abutting face 12*a* are formed to face the first end face 5*a* and the second end face 6*a*, respective. The first and second end faces 5*a*, 6*a* and the first and second abutting faces 11*a*, 12*a* shall be flat or otherwise the former may be convex and the latter may be concave, and vice versa, so as to achieve a surface-contact.

And, referring to FIG. 1, the first abutting face 11*a* has a smaller area than that of the first end face 5*a*, and the second abutting face 12*a* has also a smaller area than that of the second end face 6*a*. Therefore, the first end face 5*a* and the second end face 6*a* can be securely put into surface-contact with the first abutting face 11*a* and the second abutting face 12*a*, respectively. Accordingly, the forces P,Q (FIG. 12) arising on the first abutting face 11*a* and the second abutting face 12*a*, respectively, due to the elastic restoring force F' of the terminal assembly 3 can effectively act on the first end face 5*a* and the second end face 6*a*.

In case that the shape of both of the first end face 5*a* and the second end face 6*a* is identical, the shape of both of the first abutting face 11*a* and the second abutting face 12*a* a can be identical. In such a case, if the shape of both of one end portion and the other end portion of the strip terminal 10 of the terminal assembly 3 is identical, the second end face 6*a* can be put against the first abutting face 11*a* and the first end face 5*a* can be put against the second abutting face 12*a*.

As shown in FIG. 1, because the terminal assembly 3 is pre-molded in a state that a plurality of strip terminals 10 are arranged in parallel, the terminal assembly 3 can be elastically deformed about the bent portion 13. That is, if the terminal assembly 3 is elastically deformed by the external force F, the elastic restoring force F' acts on the terminal assembly 3 in the opposite direction. Therefore, when the external force F is removed, the terminal assembly 3 returns to the original state by means of the elastic restoring force F'.

Figure 10B:
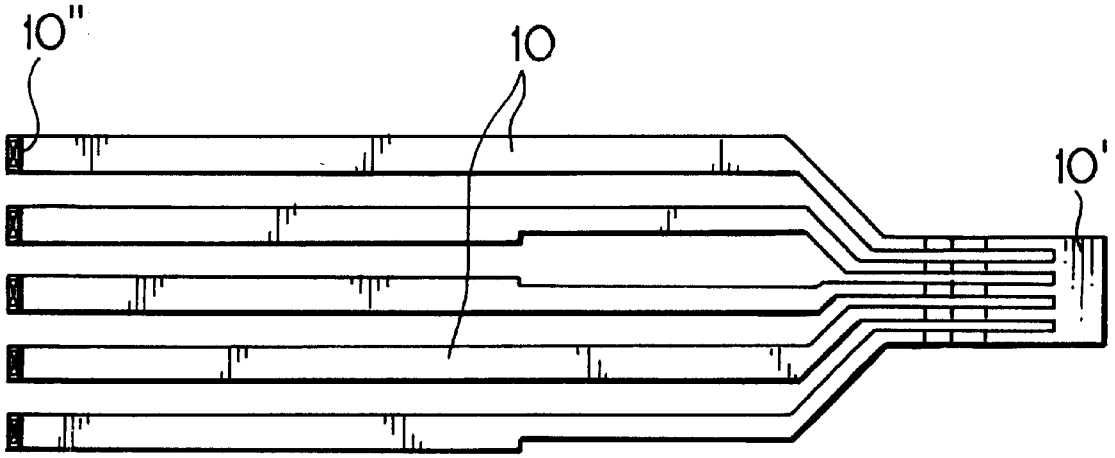
FIG. 10B is a plan view showing a plurality of strip terminals constituting the terminal assembly of FIG. 1.
Figure 10C:
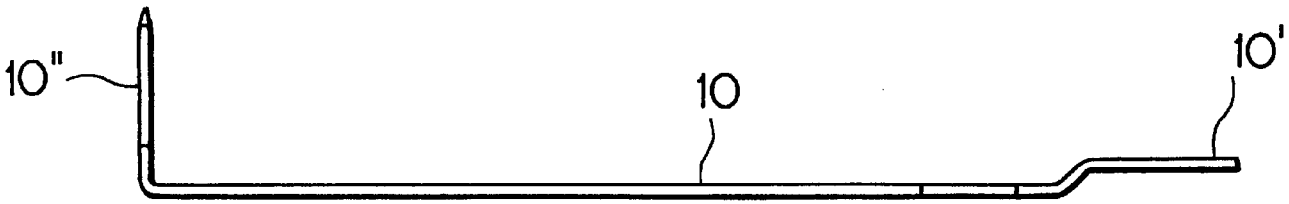
FIG. 10C is a side view showing a plurality of strip terminals constituting the terminal assembly of FIG. 1.
Figure 10A:
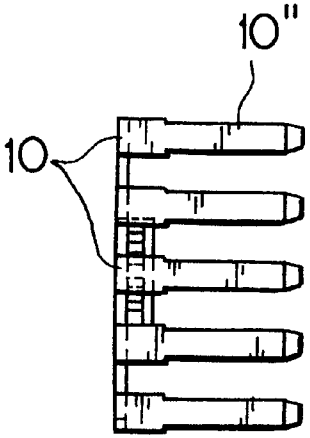
FIG. 10A is a front view showing a plurality of strip terminals constituting the terminal assembly of FIG. 1.
Figure 11B:
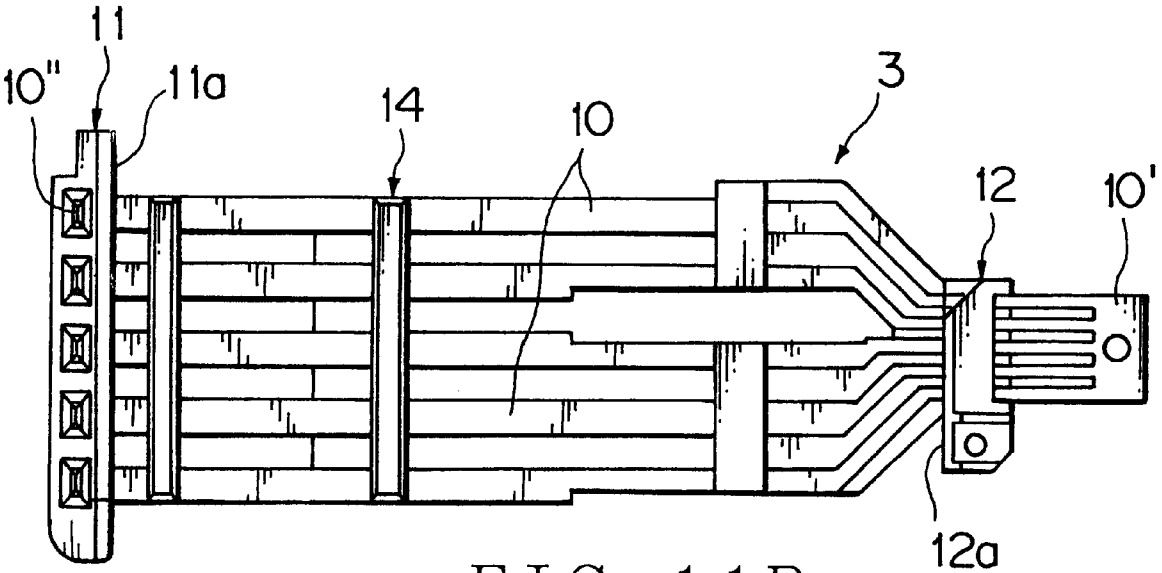
FIG. 11B is a plan view showing a pre-molded state of a plurality of strip terminals of FIG. 10.
Figure 11C:
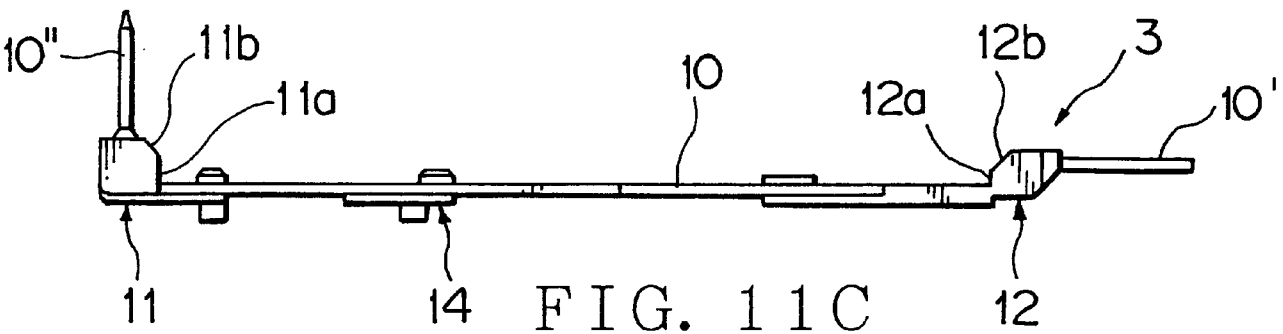
FIG. 11C is a side view showing a pre-molded state of a plurality of strip terminals of FIG. 10.
Figure 11A:
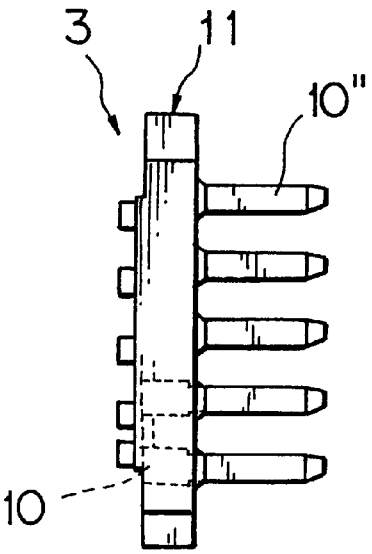
FIG. 11A is a front view showing a pre-molded state of a plurality of strip terminals of FIG. 10.
Figure 13:
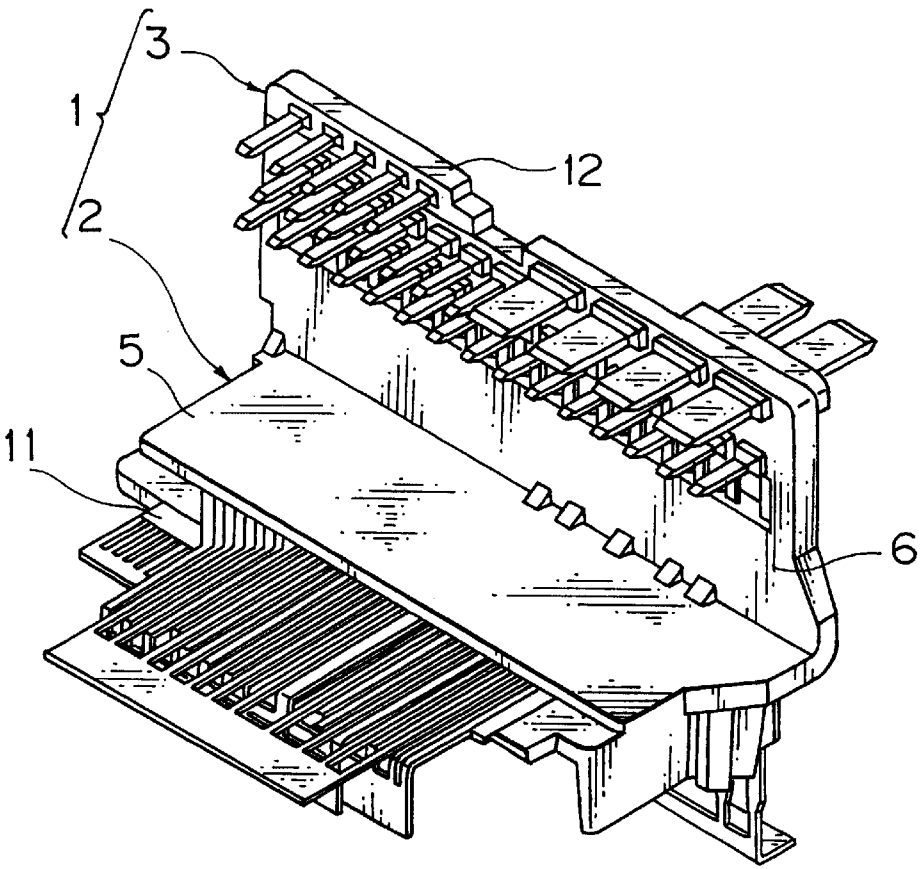
FIG. 13 is a perspective view of FIG. 12.

In the molding method of the terminal assembly 3 being shown in FIGS. 1,6–9, a plurality of strip terminals 10 are arranged as shown in FIG. 10, and the first engaging portion 11, the second engaging portion 12, and the resin band 14 are pre-molded as shown in FIG. 11. And, a suitable position of the strip terminals 10 is bent in a suitable angle.

Next, a method to form the insert-molded body 1, mailing use of the elastic restoring force F', is described.

As shown in FIG. 1, the primary molded body 2 having the first resin portion 5 and the second resin portion 6 is molded at the primary molding. The first end face 5*a* and the second end face 6*a* are provided in advance on the first resin portion 5 and the second resin portion 6, respectively, at the time of the primary molding. As shown in FIGS. 10,11, the terminal assembly 3 is pre-molded in a state that the strip terminals 10 are arranged. The first engaging portion 11 and the second engaging portion 12 are formed on the terminal assembly 3, and the first abutting face 11*a* and the second abutting face 12*a* are provided on the first engaging portion 11 and the second engaging portion 12, respectively.

Referring to FIG. 1, in case that the terminal assembly 3 is assembled under the primary molded body 2, the first abutting face 11*a* is provided inward (rightward) on the first engaging portion 11 and the second abutting face 12*a* is provided inward (leftward) on the second engaging portion 12. And, the first end face 5*a* is provided outward (leftward) on the first resin portion 5, and the second end face 6*a* is provided outward (rightward) on the second resin portion 6. The terminal assembly 3 is positioned under the primary molded body 2, and the first abutting face 11*a* is hung on or engaged with the first end face 5*a*. And, the second engaging portion 12 side of the terminal assembly 3 is elastically deformed in its widening direction, i.e. in a direction of enlarging an angle θ. When the terminal assembly 3 is elastically deformed, the elastic restoring force F' arises on the terminal assembly 3.

Figure 12:
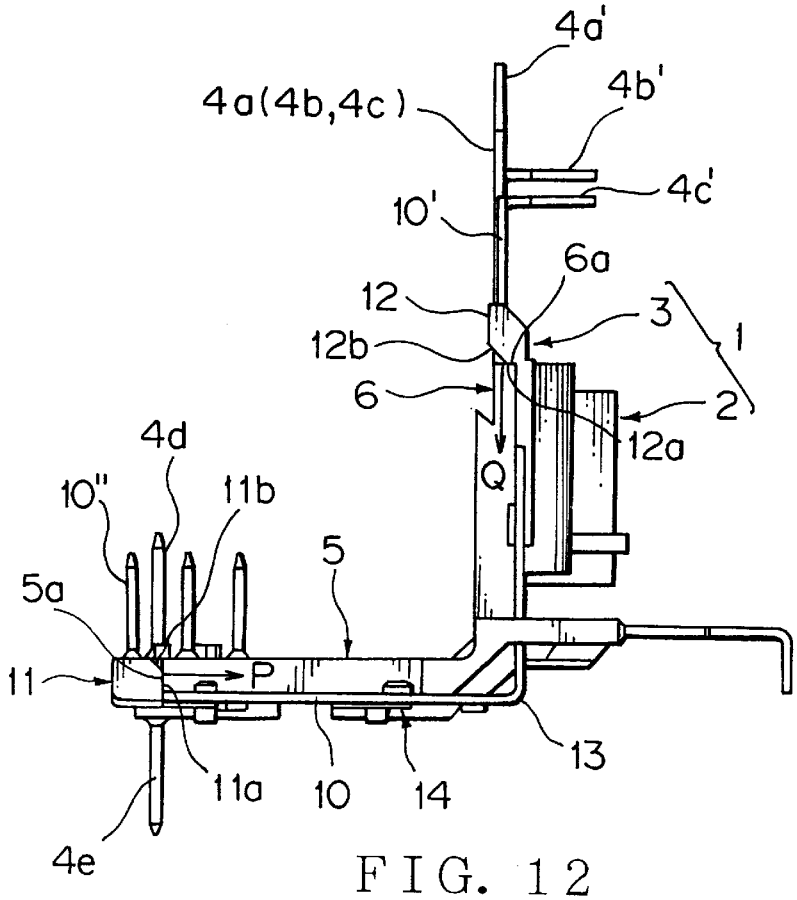
FIG. 12 is a side view showing an assembled state of the terminal assembly of FIG. 1 to the primary molded body.

In a state of the terminal assembly 3 being bent, the second abutting face 6*a* is hung on the second end face 12*a* as shown in FIG. 12. Force P acts from the first abutting face 11*a* toward the first end face 5*a* due to the elastic restoring force F' and force Q acts from the second abutting face 12*a* toward the second end face 6*a*. Accordingly, engagement between the first end face 5*a* and the first abutting face 11*a* and between the second end face 6*a* and the second abutting face 12*a* can be maintained as shown in FIG. 12. The terminal assembly 3 may be assembled over the primary molded body 2.

Figure 17:
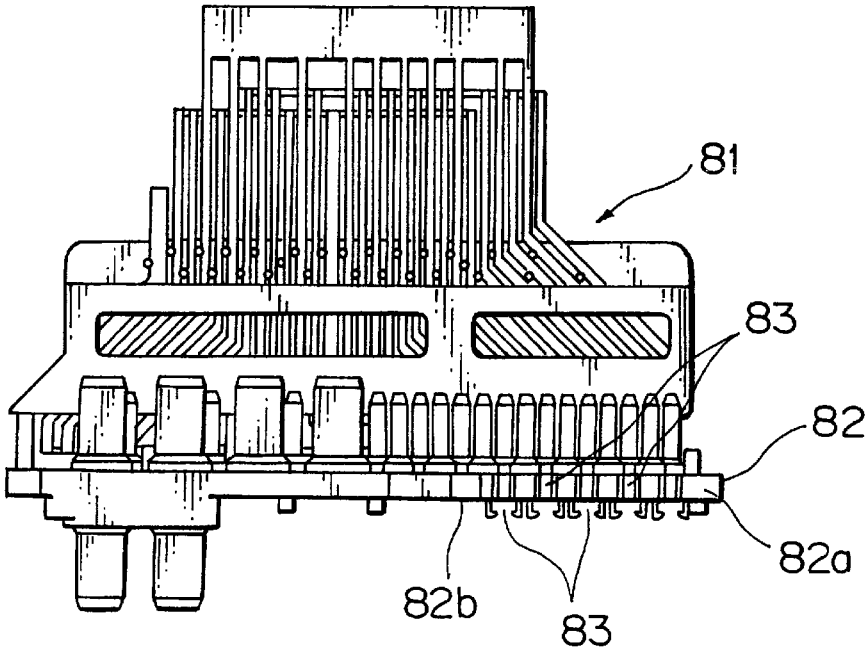
PRIOR ART FIG. 17
FIG. 17 is a side view, taken along arrow F, of the insert-molded body of FIG. 16.
Figure 16:
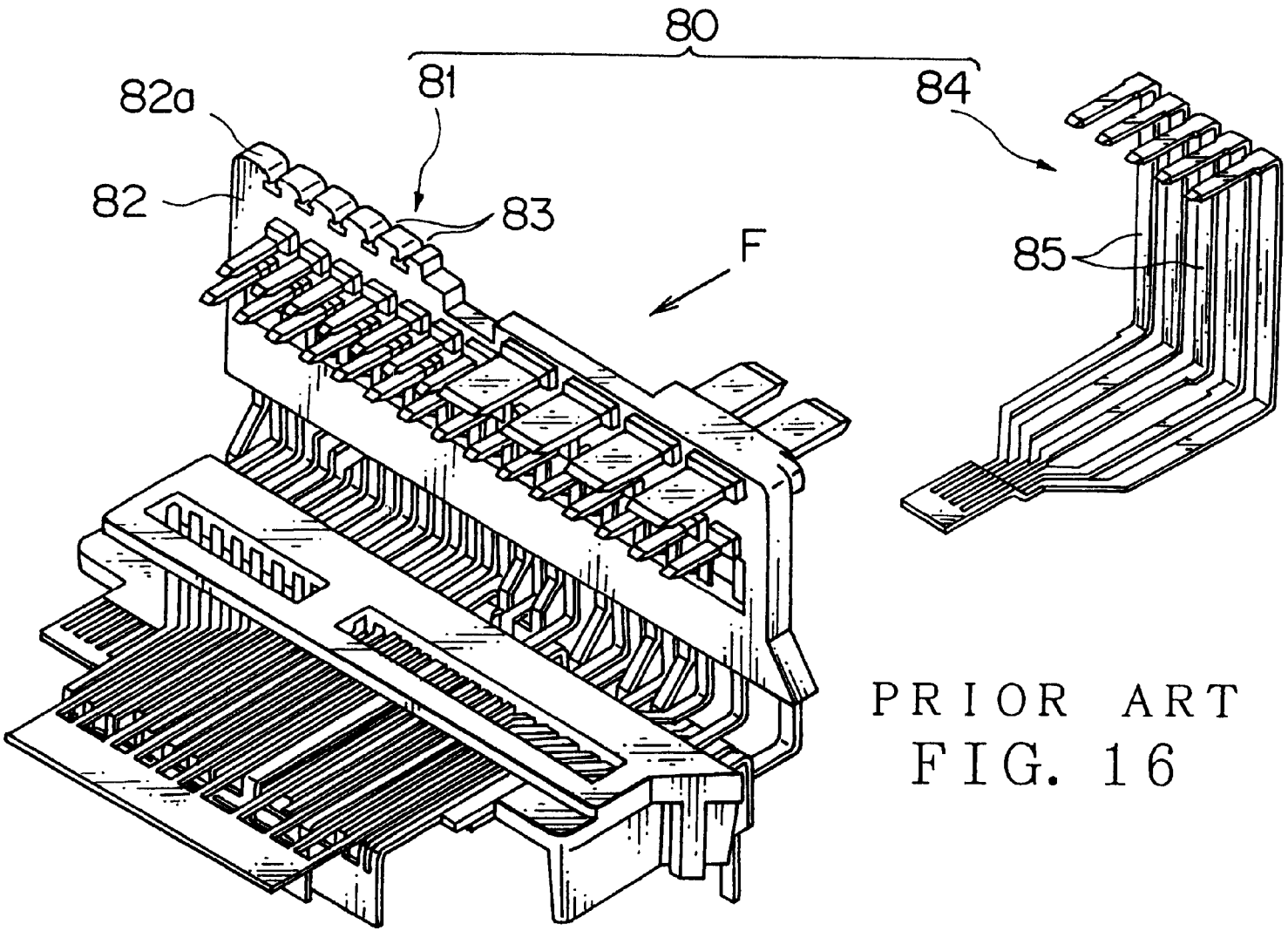
PRIOR ART FIG. 16
FIG. 16 is an exploded perspective view of a conventional insert-molded body.
Figure 18:
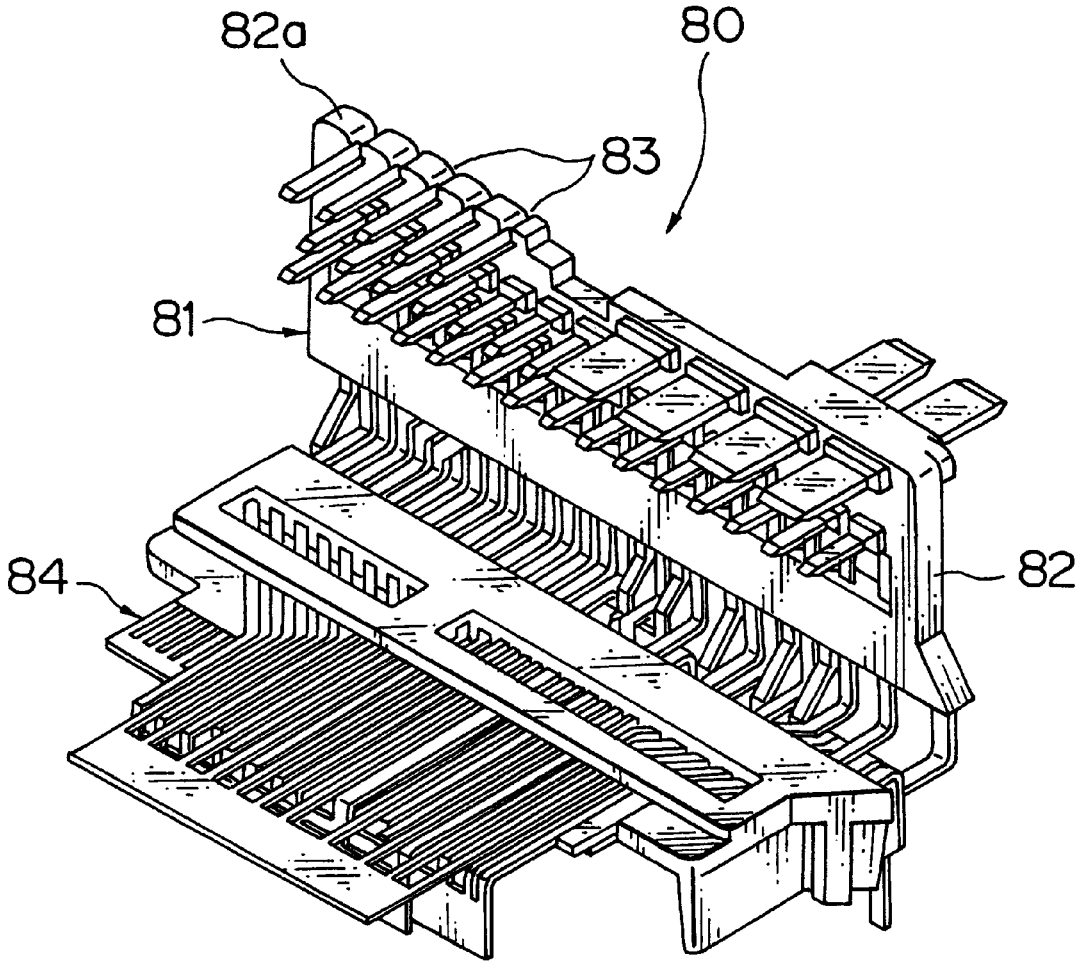
PRIOR ART FIG. 18
FIG. 18 is a perspective view showing the insert-molded body of FIG. 16.

As described above and as shown in FIG. 1 and FIG. 12, the terminal assembly 3 is held between the first resin portion 5 and the second resin portion 6 of the primary molded body 2 by its own elastic restoring force. Therefore, because the conventional locking group 83 (FIG. 17) is not required on the primary molded body 2, the primary molded body 2 can be molded with use of only a pair of metal molds (not illustrated) capable of opening/closing in one direction. Therefore, number of the metal mold can be reduced, and the structure of the metal mold can be simplified. And, because the strip terminals 10 constituting the terminal assembly 3 need not to be assembled to the primary molded body 2 one by one, trouble or time necessary for forming the insert-molded body 1 can be reduced. Therefore, operation speed of forming the insert-molded body 1 can be increased.

Figure 14:
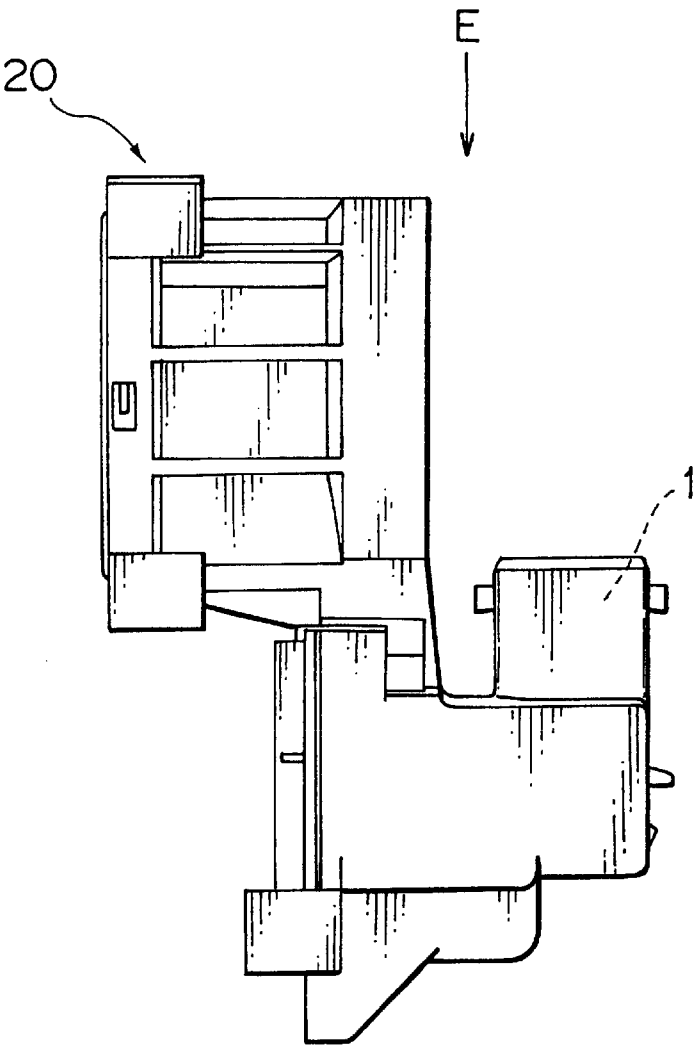
FIG. 14 is a side view showing an article having been secondary-molded, which article including inside the insert-molded body of FIG. 12.
Figure 15:
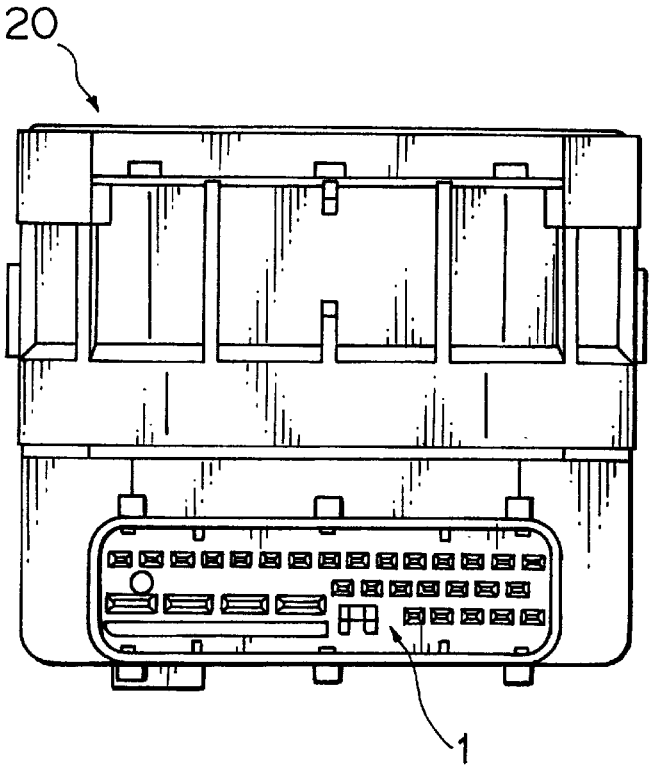
FIG. 15 is a side view, taken along arrow E, of the article of FIG. 14.

By secondary-molding the insert-molded body 1 together with the necessary member (not illustrated) after forming the insert-molded body 1, an article 20, shown in FIGS. 14,15, including the insert-molded body 1 is molded.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An insert-molded body for an electrical connector, comprising:

a primary molded body having a first resin portion and a second resin portion;

a terminal assembly of one or a plurality of strip terminals;

a bent portion on the terminal assembly and bent in a suitable angle;

a first engaging portion and a second engaging portion provided on respective sides of the bent portion each engaging portion protruding in a direction toward the primary molded body;

a first abutting face and a second abutting face provided on the first engaging portion and the second engaging portion, respectively; and a first end face and a second end face provided on the first resin portion and the second resin portion, respectively, wherein the first abutting face and the second abutting face abut against the first end face and the second end face, respectively, due to elastic restoring force arising on the terminal assembly by changing a bending angle of the bent portion; and wherein the first and second engaging portions of the terminal assembly are provided with respective inclined planes to facilitate abutment against the respective first and second end faces.

2. The insert-molded body as set forth in claim 2, wherein the terminal assembly is tabular.

3. A method of molding an insert-molded body for an electrical connector, comprising the steps of:

molding a primary molded body having a first resin portion and a second resin portion having a first end face and a second end face, respectively;

forming a terminal assembly consisting of one or a plurality of strip terminals;

forming a bent portion by bending the terminal assembly in a suitable angle;

molding a second engaging portion and a first engaging portion on the terminal assembly at respective ends of the bent portion of said terminal assembly, each engaging portion protruding in a direction toward the primary molding body and being provided with an inclined plane to facilitate abutment against the corresponding end face;

forming a first abutting face and a second abutting face on the first molded engaging portion and the second molded engaging portion, respectively;

hanging the first abutting face on the first end face of the first resin portion;

hanging the second abutting face on the second end face of the second resin portion, while elastically deforming the terminal assembly; and holding the terminal assembly on the primary molded body by means of elastic restoring force arising on the terminal assembly.

* * * * *